United States Patent [19]

Krueger et al.

[11] 4,333,516

[45] Jun. 8, 1982

[54] CORRODIBLE CONTAINER FOR AUTOMATIC ADDITION OF CORROSION INHIBITOR TO A COOLANT SYSTEM

[75] Inventors: Robert H. Krueger, Palatine; Clarence E. Albertson, Villa Park, both of Ill.; Bruce P. Miglin, Columbus, Ohio

[73] Assignee: Borg-Warner Corporation, Chicago, Ill.

[21] Appl. No.: 214,843

[22] Filed: Dec. 10, 1980

Related U.S. Application Data

[63] Continuation of Ser. No. 88,506, Oct. 26, 1979, abandoned, which is a continuation-in-part of Ser. No. 964,219, Nov. 27, 1978, abandoned.

[51] Int. Cl.[3] ..... F28F 19/00

[52] U.S. Cl. ..... 165/1; 137/67; 165/12; 165/134 R; 206/229; 206/524.4; 220/DIG. 30; 222/54

[58] Field of Search ..... 220/DIG. 30; 206/219, 206/207, 524.4, 229; 165/1, 12, 71, 134 R; 203/7; 208/47; 62/85; 222/52, 54, 541; 137/67, 268

[56] References Cited

U.S. PATENT DOCUMENTS

| | | | |
|---|---|---|---|
| 2,335,826 | 11/1943 | George | 106/14.13 |
| 2,560,649 | 7/1951 | Hornaday | 206/229 |
| 2,635,996 | 4/1953 | Rohrback et al. | 206/524.4 |
| 3,787,650 | 1/1974 | Lewis | 137/67 |
| 3,809,150 | 5/1974 | Holmes | 165/134 R |
| 3,896,969 | 7/1975 | Basile | 222/54 |
| 3,943,960 | 3/1976 | Syrenne | 137/268 |
| 4,013,127 | 3/1977 | Tenney et al. | 222/54 X |
| 4,121,734 | 10/1978 | Soong et al. | 222/54 |

FOREIGN PATENT DOCUMENTS

| | | | |
|---|---|---|---|
| 897615 | 4/1972 | Canada | 220/DIG. 30 |
| 873341 | 4/1953 | Fed. Rep. of Germany . | |
| 522575 | 6/1940 | United Kingdom | 165/134 R |

*Primary Examiner*—Sheldon J. Richter
*Attorney, Agent, or Firm*—James A. Geppert

[57] ABSTRACT

A corrodible container for the storage of a corrosion inhibitor to be suitably located in the coolant system of an automotive vehicle or other environment wherein the container has at least a portion thereof formed of substantially the same material as the material forming the heat exchange device in a coolant system so as to corrode when the coolant is partially or wholly replaced by a corrosive liquid such as water. More specifically, an aluminum radiator has a tendency to corrode rapidly where corrosive water is present and the container for the corrosion inhibitor has at least a portion thereof formed of aluminum foil or aluminum sheet material with a thinner portion so that the foil or thinner portion will corrode through to release the corrosion inhibitor into the coolant to minimize corrosion of the heat exchanger and coolant system.

36 Claims, 16 Drawing Figures

CORRODIBLE CONTAINER FOR AUTOMATIC ADDITION OF CORROSION INHIBITOR TO A COOLANT SYSTEM

CROSS REFERENCE TO RELATED APPLICATION

The present application is a continuation of application Ser. No. 88,506, filed Oct. 26, 1979 and now abandoned, which in turn was a continuation-in-part of application Ser. No. 964,219, filed Nov. 27, 1978, now abandoned.

BACKGROUND OF THE INVENTION

Engine coolants for the cooling system of an automotive vehicle usually contain ethylene glycol and a small percentage of diethylene glycol. This fluid is diluted with water to provide a 50% or lower concentration of glycol depending on the desired freezing point for the coolant system. Most companies that manufacture and/or distribute ethylene glycol for coolant systems add corrosion inhibitors to the solution to prevent corrosion of the copper-brass traditionally used in the manufacture of vehicle radiators.

These inhibitors usually are a mixture of one or more inorganic salts, such as phosphates, borates, nitrates, nitrites, silicates or arsenates, and an organic compound, such as benzotriazole, tolyltriazole or mercaptobenzothiazole, to prevent copper corrosion. The solution is generally buffered to a pH of 8 to 10 to reduce iron corrosion and to neutralize any glycolic acid formed in the oxidation of ethylene glycol. Most companies recommend a maximum of one or two years' service for their antifreeze coolant, however, it has been found that the average car owner does not follow the owner's instruction manual to maintain −20° F. protection for the coolant system and does not check the coolant to determine if it is rusty or dirty. Many owners only add water when the antifreeze is lost through leakage or hose breakage. This is more likely to occur in the southern part of the country than in northern areas.

In normal passenger car service, 25% of the cars require coolant system servicing after only one year; after two years this percentage rises to 50%. With normal copper-brass radiators, and even more so with aluminum systems, it is extremely important that the antifreeze or coolant mixture contain 50 to 55% of the correctly inhibited ethylene glycol. A reduction to a mixture of 33% ethylene glycol—67% water will increase metal corrosion significantly. This is especially important with higher temperature coolant systems which are becoming more common with the increased use of emission controls.

Also, with the increasing emphasis on gas mileage of the new automobiles, cars are being downsized and reduced in weight through the substitution of lightweight metals or plastics for iron and steel where practical. In the automotive coolant systems, aluminum radiators are being utilized instead of the conventional copper-brass radiators previously used. As above noted, an aluminum radiator is more susceptible to the corrosive action of a coolant or antifreeze that is low in the percentage of ethylene glycol and/or where an insufficient amount of corrosion inhibitor is present in the coolant. In such a system, additional corrosion inhibitor must be added or the aluminum will begin to corrode by pitting at a rapid rate. The present invention ameliorates this corrosion problem by providing for the automatic addition of a corrosion inhibitor under corrosive conditions for the coolant.

SUMMARY OF THE INVENTION

The present invention relates to a device for the automatic addition of corrosion inhibitor when the corrosiveness of the engine coolant in a vehicle reaches or exceeds a predetermined level wherein the device comprises a closed container for the solid or liquid corrosion inhibitor with at least a portion of the container formed of substantially the same material as the heat exchanger or radiator through which the coolant passes and exhibits its corrosive tendencies. The container portion should not corrode in properly inhibited ethylene glycol-water solution, however, as the coolant becomes corrosive, the corrodible portion of the container will corrode at a rate faster or equivalent to that of the radiator. As the corrodible material is much thinner than the radiator material, it would be quickly penetrated to release the corrosion inhibitor into the coolant system.

The present invention also relates to a device for releasing corrosion inhibitor into a coolant system where a foil of the material forming the radiator either forms a portion of one end of a container or forms a foil packet containing the corrosion inhibitor. The foil is exposed to the coolant in the cooling system of the vehicle by insertion in a tank of the radiator, in the overflow reservoir for the coolant, or in a flow line leading to or from the radiator so as to have the foil in contact with the coolant.

The present invention further relates to a device for releasing corrosion inhibitor wherein the container is either a glass, plastic or metal member open at one or both ends and having a foil of substantially the same material as the radiator covering the open ends. The foil is suitably secured to the container by an adhesive or a screw top cover having an opening therein. If the container is metal, a small tab opening in the end may be covered with the foil.

The present invention comprehends the provision of a container for corrosion inhibitor having an opening in an end or an open end covered with aluminum foil wherein the radiator is formed of aluminum sheet material brazed together.

The present invention also comprehends the provision of a container for corrosion inhibitor formed of a metal less corrodible than aluminum with an aluminum end secured to the container along its periphery and having a scored or knurled portion in the end to provide a limited area of a reduced thickness. When the coolant becomes corrosive, the scored area will be attacked and corrode by pitting to a greater degree than the surrounding metal so as to provide for an earlier penetration and release of the corrosion inhibitor.

The present invention further comprehends the provision of a container packaging the corrosion inhibitor to provide for a release of the inhibitor more than once. A foil packet is formed with corrosion inhibitor sealed therein. This foil packet along with additional inhibitor is sealed in a larger foil packet, and this packet in turn with additional inhibitor is sealed in a larger packet. Thus the outer packet would corrode first to release its inhibitor and the remaining packets would be available to give further protection at a later time. A dye could be added within the innermost packet to indicate to the owner that a new inhibitor package is required.

Further objects of the present invention are to provide a construction of maximum simplicity, efficiency, economy, and ease of operation, and such further objects, advantages and capabilities as will later more fully appear and are inherently possessed thereby.

DESCRIPTION OF THE PREFERRED EMBODIMENTS

Figure 1:
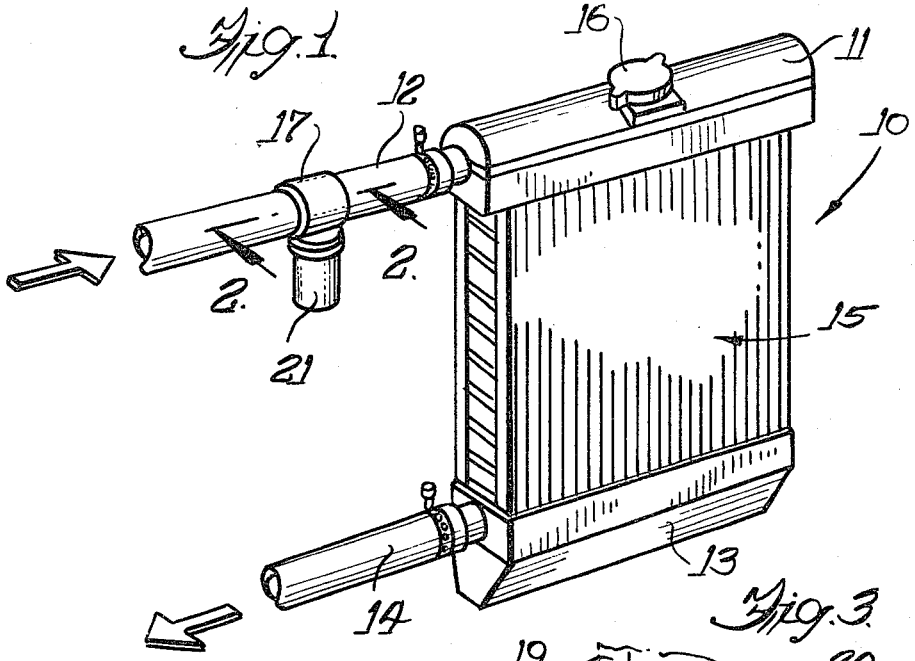
FIG. 1 is a perspective view of an automobile radiator showing one method of positioning a corrosion inhibitor container in cooperation therewith.

Referring more particularly to the disclosure in the drawings wherein are shown illustrative embodiments of the present invention. FIG. 1 discloses an automobile radiator 10 for the coolant system of the vehicle engine (not shown). The radiator includes an inlet tank 11 having an inlet hose 12 communicating therewith, an outlet tank 13 with an outlet hose 14 extending therefrom, and a heat exchange core 15 including a plurality of tubes extending between and connecting the inlet and outlet tanks and folded or corrugated heat exchange fins between the tubes allowing air to pass between the tubes but breaking the airstream up to enhance the heat exchange characteristics of the radiator. The inlet tank is also provided with an inlet neck closed by a pressure cap 16 and a conventional overflow tube (not shown) is connected to the neck to allow for overflow of the coolant in the radiator to the overflow reservoir. The radiator may be of the downflow type as shown or of the crossflow type.

Figure 2:
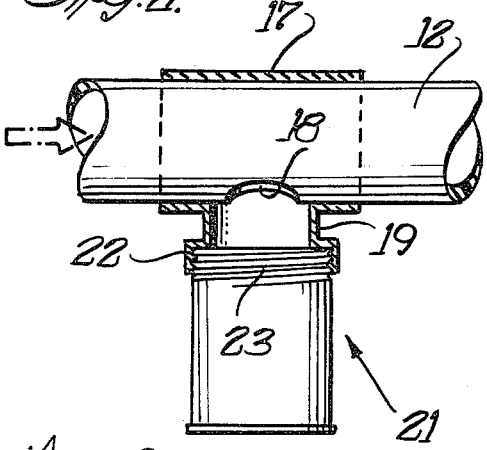
FIG. 2 is an enlarged side elevational view partially in cross section showing the mounting for the container taken on the line 2—2 of FIG. 1.

As seen in FIGS. 1 and 2, a T-connector 17 is inserted into the inlet hose 12, either by sealingly fitting over the hose with an opening 18 in the hose communicating with the depending leg 19 of the connector or by inserting the connector into a break in the hose (not shown). The depending leg 19 receives a container 21 for a corrosion inhibitor in either solid or liquid form and seals around the upper end 22 of the container by screw threads 23 (see FIG. 2) or by an exterior clamp (not shown). The T-connector is equally adapted to be located in the outlet hose 14.

Figure 3:
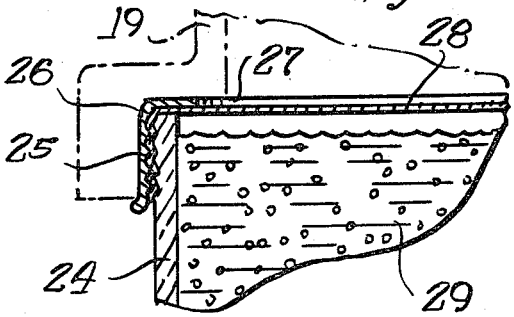
FIG. 3 is an enlarged partial cross sectional view of a container for corrosion inhibitor.

The container shown in FIGS. 2 and 3 is a jar 24 closed at the bottom and open at the top formed of a suitable glass or plastic material able to withstand the temperature of the heated fluid and the temperatures present within the engine compartment. The upper end of the jar has exterior screw threads 25 for a threaded cap 26 having a central opening 27. A piece of metal foil 28 is positioned over the open end of the jar 24 filled with a corrosion inhibitor 29 and formed over the threads 25. The cap 26 is screwed onto the jar to seal the foil thereon, and one or more rubber gaskets may be necessary in the cap to improve the seal.

The engine coolant is preferably a 50—50 mixture of ethylene glycol and water with a corrosion inhibitor in the ethylene glycol as supplied to the vehicle owner. This mixture is circulated from the radiator 10 by a fluid pump through the engine block for cooling. The coolant, heated from the engine block, is returned to the radiator for cooling by a forced air flow through the radiator core 15 around the tubes connecting the tanks 11 and 13. As the liquid passes through the inlet hose 12, it will contact the metal foil 28 on the container 21. If a leak develops in the coolant system or a hose ruptures, the owner is likely to replace the coolant with water from any readily available source. This water obviously is not treated and is likely to be corrosive to the metal of the radiator.

As the metal foil 28 is of substantially the same material as the radiator construction and is considerably thinner than the material stock forming the radiator, the corrosive water will tend to attack the foil as it passes through the hose 12, and the foil would tend to corrode at the same or a faster rate than the radiator depending on the alloy composition. When penetration of the foil is achieved, the coolant will dissolve a solid inhibitor and/or force the liquid inhibitor into the coolant stream to stop or retard the corrosion of metals in the coolant system.

For the conventional copper-brass radiator system, a copper foil would be used to seal the jar 24. Likewise, if an aluminum radiator were substituted for the copper-brass one, then an aluminum foil would be used. For the aluminum radiator, the corrosion problem is of utmost importance because of the faster rate of corrosion by pitting compared to copper-brass. Tests were run using a glass vial with aluminum foil of a thickness of 0.75 mil over the open end and a corrosion inhibitor of either disodium hydrogen phosphate or lithium nitrate. Tests were run at room temperature with the foil exposed to a conventional antifreeze solution and to a corrosive water containing 300 ppm chloride ion as sodium chloride and 1.0 ppm copper ion. After several days, analysis of the antifreeze showed no change for disodium hydrogen phosphate or lithium nitrate in the antifreeze, while the corrosive water showed a marked increase in the concentration of the particular inhibitor in each case.

Figure 4:
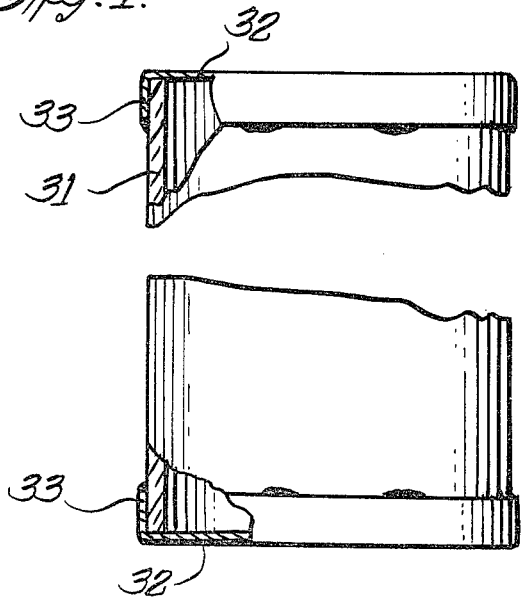
FIG. 4 is a side elevational view partially in cross section of a second embodiment of container.

FIG. 4 discloses a second embodiment of container for the corrosion inhibitor using a glass or plastic tube 31 open at both ends, with each end covered by a suitable metal foil 32 which is sealed at the edges 33 by bonding using a fast cure epoxy resin or glued with a Pliobond (rubber base) adhesive. Other suitable adhesives include silicones, acrylics or cyanoacrylates.

Figure 5:
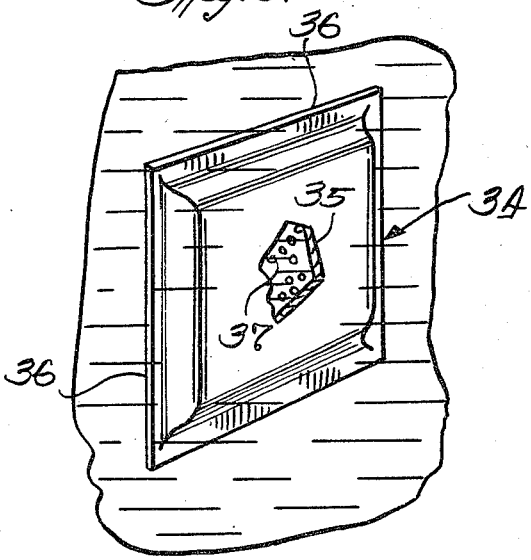
FIG. 5 is a perspective view of a third embodiment of container for corrosion inhibitor.

FIG. 5 discloses a third embodiment of container 34 for a corrosion inhibitor which is adapted to be positioned with the inlet tank 11 of the radiator 10 or in the overflow tank (not shown). This container is a packet formed from two sheets of a suitable foil 35 sealed around all four edges 36 with a predetermined quantity of corrosion inhibitor 37 therein. The edges are sealed with a suitable adhesive or mechanical means, such as ultrasonic welding could be used. Under cyclic temperature conditions, a double sealed aluminum foil package may be necessary. To accomplish this, strips of foil are folded over the original packet edges 36 and then sealed to the edges using a suitable adhesive or mechanical means FIGS. 6 and 7 disclose a fourth embodiment of container 38 adapted to provide more than one charge of corrosion inhibitor when positioned in the radiator tank or overflow container. This container consists of a first foil packet 39 containing a predetermined quantity of corrosion inhibitor 41, a second foil packet 42 receiving the first packet 39 therein along with a second quantity of inhibitor 43, and a third foil packet 44 receiving the second packet 42 along with a third quantity of inhibitor 45. All three packets 39,42 and 44 can be sealed along their individual edges 46 as shown in FIG. 7 or all three packets can be sealed simultaneously along common edges (not shown).

With this container 38, corrosion inhibitor would be released more than once as the corrosiveness of the coolant varies. When the container 38 is first introduced into the ethylene glycol-water mixture, the outer foil packet 44 would not be attacked. As the corrosiveness of the coolant increased, the outer foil packet would corrode to release the inhibitor 45. The inner packets would remain intact to give further protection, if needed at a later date. As the effectiveness of the inhibitor decreased, the second foil packet 42 would corrode releasing the inhibitor 43; and later, the inner foil packet 39 would corrode to release the inhibitor 41. A colored dye could be added to the inhibitor 41 in the packet 39 to be released as a visual signal that a new inhibitor package is needed.

Figure 8:
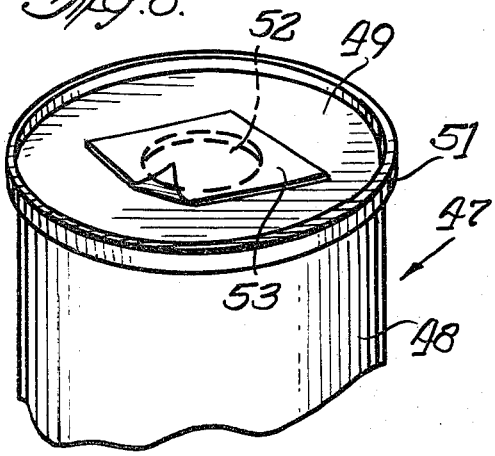
FIG. 8 is a partial perspective view of a fifth embodiment of corrosion inhibitor container.

FIG. 8 discloses a fifth embodiment of container 47 to be inserted into the T-connector 17 of FIG. 1. This container consists of a steel or aluminum body 48 which is normally drawn to provide a one-piece side wall and bottom or a separate bottom may be secured to the side wall. A top 49 is secured to the upper end of the body 48 by a conventional flanging operation as at 51. The metal top has an opening 52 formed therein which may be as shown in dotted outline in FIG. 8 or the opening may be of the conventional pull-tab or "pop top" design. A piece of foil 53 is positioned over the opening 52 and secured around the edges by a suitable adhesive or mechanical means. In this embodiment, the foil 53 would be attacked by the corrosive liquid to pit and allow penetration of the liquid into the can body 48 to contact and/or dissolve the inhibitor and carry it into the coolant system.

Figure 9:
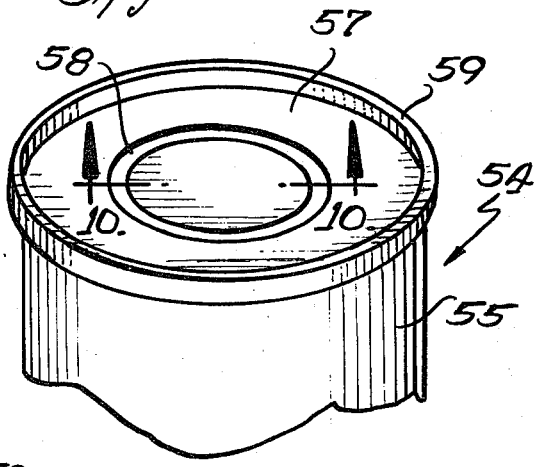
FIG. 9 is a partial perspective view of a sixth embodiment of corrosion inhibitor container.
Figure 10:
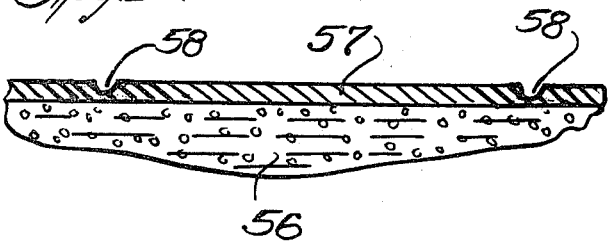
FIG. 10 is a partial cross sectional view taken on the line 10—10 of FIG. 9.

FIGS. 9 and 10 disclose a sixth embodiment of container 54 having a drawn steel or aluminum body 55 to receive the corrosion inhibitor 50 therein. The body has an open end covered with a sheet of material 57 substantially identical to the radiator material requiring corrosion protection. The top material 57 is scored as at 58 or knurled to provide lines or bands of material that are thinner than the sheet stock for the top and the top is secured to the body by a flange at 59. This container is also adapted to be received in the T-connector 17 of FIG. 1. When exposed to a corrosive coolant liquid, the scored portion 58 of the top 57 will tend to corrode or pit before the remainder of the lid and penetration of this scored portion will allow entrance of the coolant into the container and release of the corrosion inhibitor therein.

The corrosion inhibitor release rate can be controlled by the score depth and/or increased by use of a galvanic couple. Also, the top 57 could be formed of a metal alloy similar to that of the radiator but more susceptible to corrosion.

Figure 11:
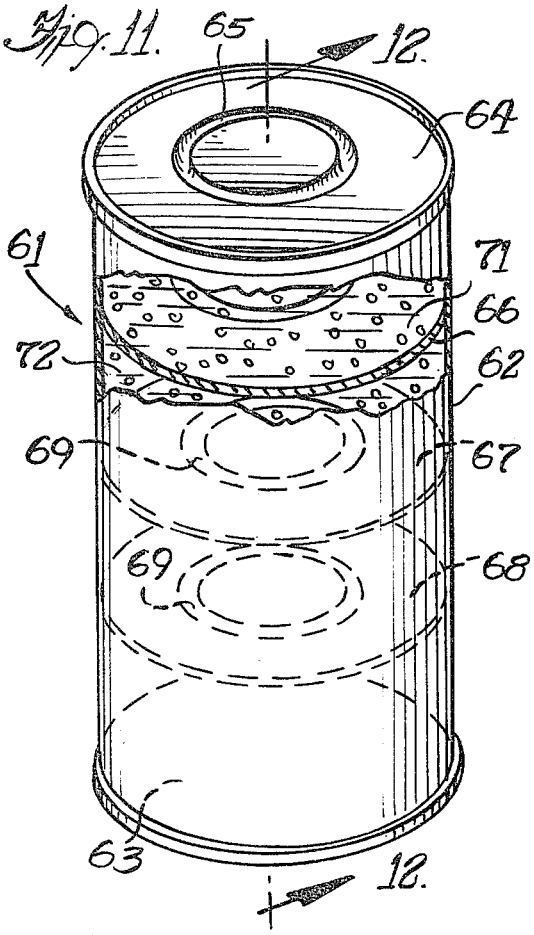
FIG. 11 is a perspective view of a seventh embodiment of corrosion inhibitor container.
Figure 12:
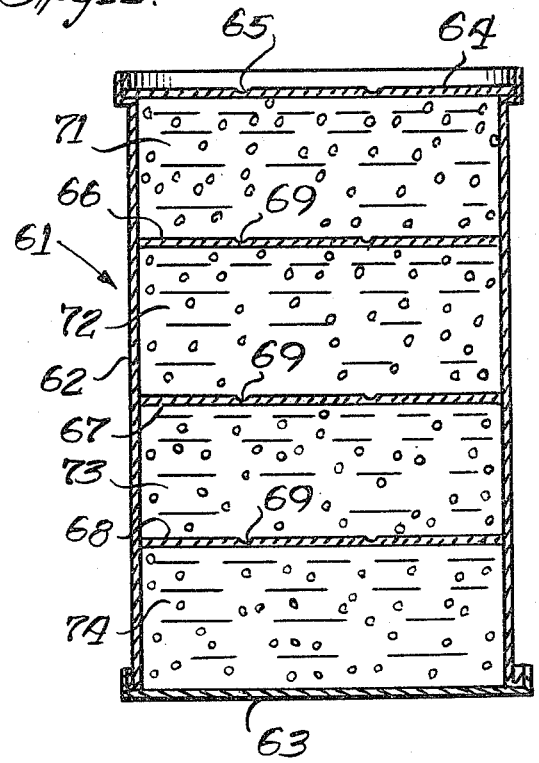
FIG. 12 is a vertical cross sectional view of the container taken on the line 12—12 of FIG. 11.

FIGS. 11 and 12 disclose a seventh embodiment of container 61 similar to the container 54 except for several partitions 66, 67 and 68, each having a scored or knurled portion 69. The container 61 includes a drawn side wall 62 with an integral or attached bottom wall 63 and a top wall 64 formed of a material substantially identical to the radiator material requiring corrosion protection. The top wall has a knurled or scored portion 65 which will tend to pit or corrode before the remainder of the top wall.

The partitions 66, 67 and 68 act to separate the corrosion inhibitor into four individual portions 71, 72, 73 and 74 which will be released sequentially. Thus, with the top wall 64 of the container 61 exposed to the coolant flow, when the concentration of corrosion inhibitor decreases below a predetermined level or the corrosiveness of the coolant increases, the scored portion 65 will pit and corrode until penetration of the wall allows the coolant to contact the inhibitor portion 71 and release the inhibitor into the coolant stream. This cycle will repeat itself for each of the partitions 66, 67 and 68 to retain a proper corrosion inhibitor level over an extended period of time. Although shown as a single container wall 62 with intermediate partitions, the container can also be formed as several individual containers joined together such that the wall 62 would become four short cylindrical wall portions with the top wall or a partition forming the end of each short container.

Figure 6:
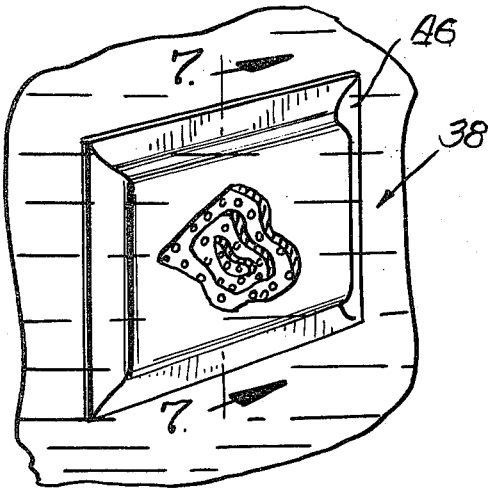
FIG. 6 is a perspective view of a fourth embodiment of container for multiple charges of inhibitor.
Figure 7:
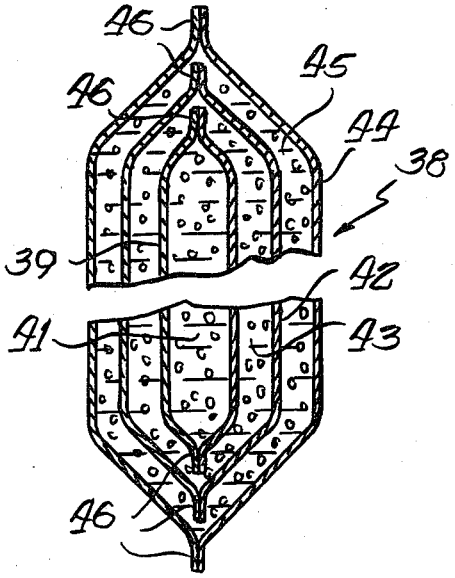
FIG. 7 is a cross sectional view taken on the line 7—7 of FIG. 6.
Figure 13:
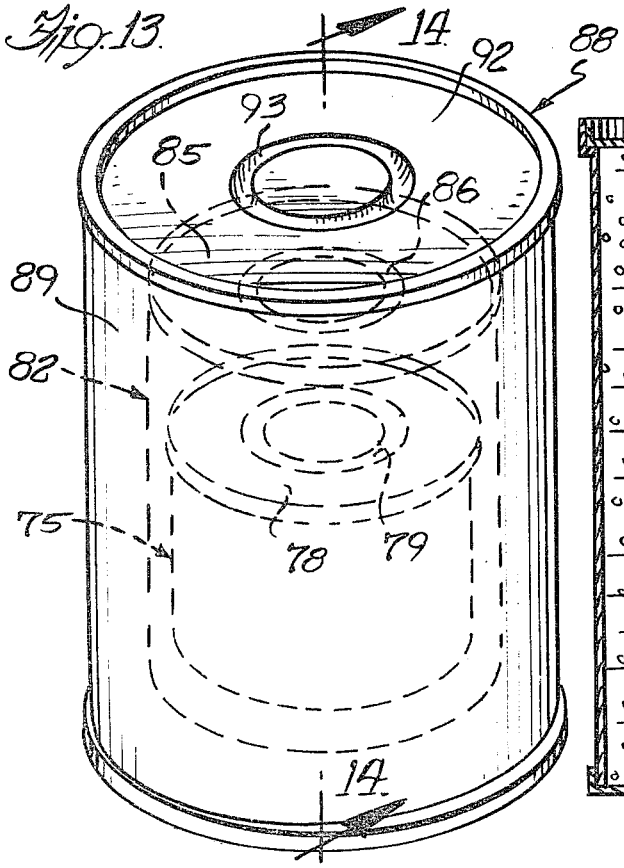
FIG. 13 is a perspective view of an eighth embodiment of inhibitor container.
Figure 14:
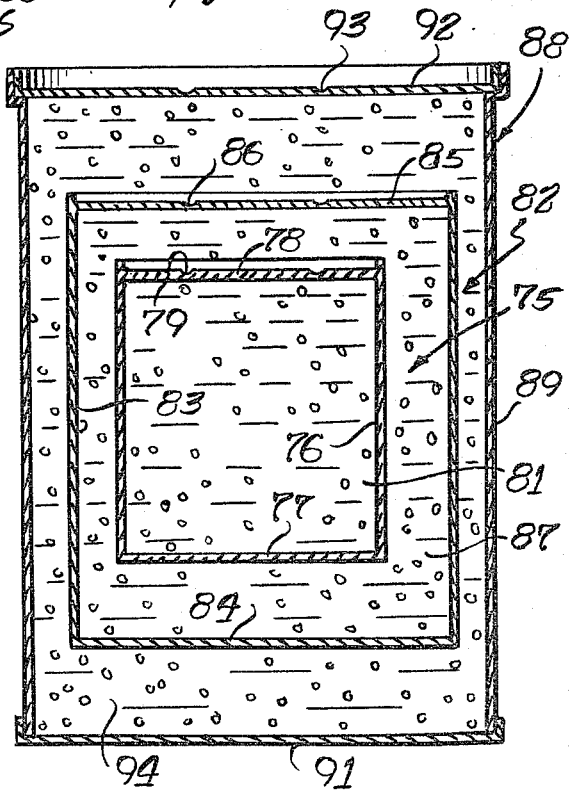
FIG. 14 is a vertical cross sectional view taken on the line 14—14 of FIG. 13.

FIGS. 13 and 14 illustrate an eighth embodiment of container assembly similar to the foil packet assembly of FIGS. 6 and 7. This assembly comprises an inner container 75 having a cylindrical side wall 76, a bottom wall 77 and a top wall 78 secured thereto and filled with corrosion inhibitor 81. The top wall is provided with a scored or knurled portion 79. An intermediate container 82 having a side wall 83, bottom wall 84 and a top wall 85 with a scored portion 86 houses the inner container 75 and a second charge of inhibitor 87. An outer container 88 also includes a side wall 89, bottom wall 91 and top wall 92 with a scored portion 93; the container housing the intermediate and inner containers 75 and 82 and a third charge of inhibitor 94. This embodiment provides a sequential addition of corrosion inhibitor in substantially the same manner as the embodiment of FIGS. 6 and 7.

Of the various corrosion inhibitors, several exhibit properties of expansion of the salt from the anhydrous to the hydrated salt, which expansion in a container with a foil covered end or ends will force out the foil or crack the container and effect a rapid release of the inhibitor into the coolant system. One such salt is anhydrous disodium hydrogen phosphate. Other such salts that expand when hydrated include sodium acetate, sodium metaborate, sodium tetraborate, sodium carbonate, sodium chromate, sodium molybdate, sodium phosphate, sodium pyrophosphate, sodium silicate and sodium sulfate. Organic polymers which are water soluble or swellable and may expand when hydrated include cellulosic products, polyacrylic acid, polyacrylamide and poly(ethylene oxide).

Figure 15:
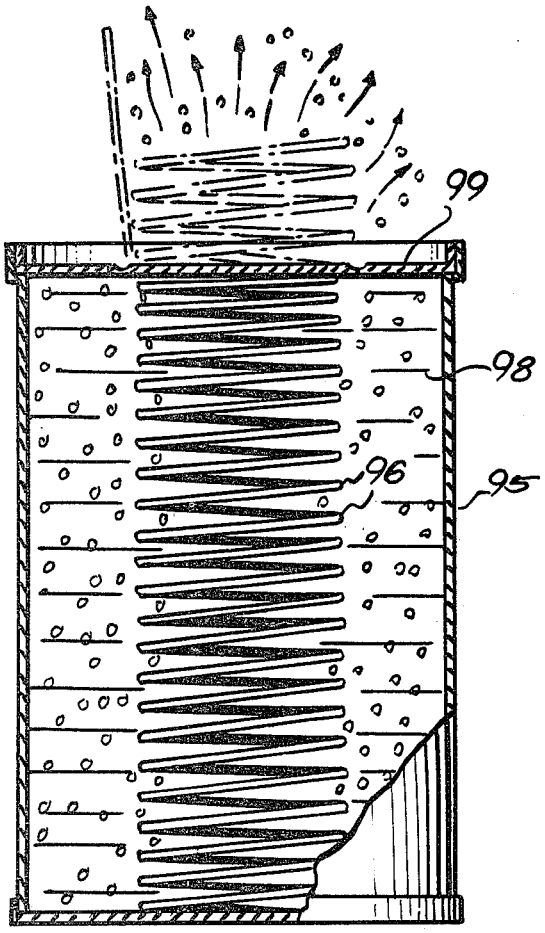
FIG. 15 is a vertical cross sectional view of a ninth embodiment of inhibitor container.
Figure 16:
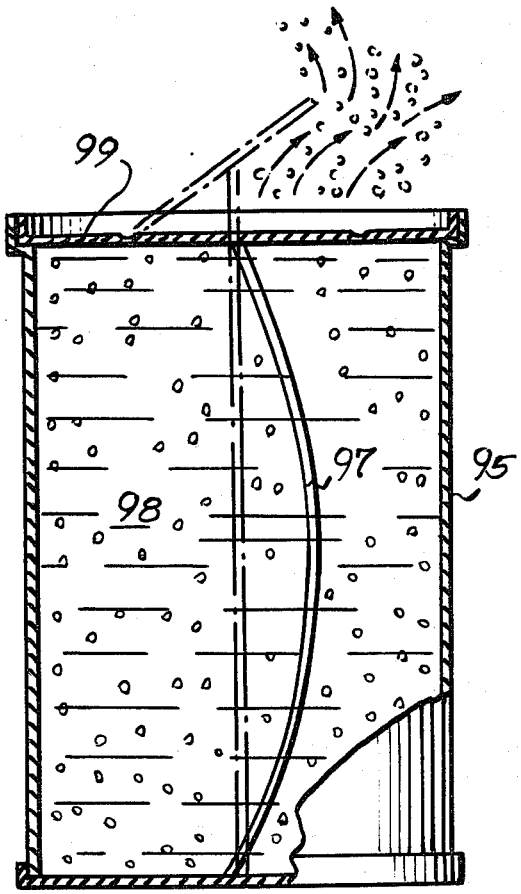
FIG. 16 is a vertical cross sectional view of a tenth embodiment of inhibitor container.

Another method of destroying the foil once it has been weakened by corrosion, as seen in FIGS. 15 and 16 is the provision of a compressed coil spring 96 or leaf spring 97 in the container 95 with the inhibitor 98. The spring 96 or 97 is of a strength to be compressed when the foil 99 is sealed onto the container but would rip open the foil and/or push out the inhibitor when the foil was weakened by corrosion.

Although the present invention is shown and described for controlling corrosion resistance in an automobile coolant system, this system can be utilized in other heat exchange systems where ethylene glycol or similar coolant is provided as the heat exchange medium.

We claim:

1. A method for the addition of a corrosion inhibitor to a coolant system when the coolant becomes corrosive, comprising the steps of forming a container to house the corrosion inhibitor, providing at least a portion of the container of substantially the same metal as a heat exchanger where corrosion is to be resisted but thinner than the metal stock forming the heat exchanger, and exposing said container portion of the same metal as the heat exchanger to the coolant, so that as the corrosiveness of the coolant increases, the container portion will be attacked until penetration occurs and the corrosion inhibitor is released.

2. The method as set forth in claim 1, in which the container portion is formed of a metal foil of the same metal as the heat exchanger to be protected.

3. The method as set forth in claim 2, in which a plurality of partitions are located in the container formed of the metal resisting corrosion with inhibitor between the partitions to provide a sequential release of inhibitor.

4. The method as set forth in claim 2, in which a plurality of containers are nested one within the next with a charge of corrosion inhibitor in each container.

5. The method as set forth in claim 1, in which said container is a metal foil packet.

6. The method as set forth in claim 5, in which the foil packet is inserted into the heat exchanger.

7. The method as set forth in claim 5, in which a plurality of foil packets are nested one within the next with a charge of corrosion inhibitor in each packet.

8. The method as set forth in claim 1, including the step of providing an expandible anhydrous salt as a corrosion inhibitor in the container so that upon penetration of the container portion by the coolant to contact the salt, the salt rapidly expands to rupture said container portion and allow release of the inhibitor.

9. The method as set forth in claim 1, including the step of positioning an expandible spring in the container biased against said container portion, so that upon weakening the container portion by corrosion, the spring will rupture the container portion to rapidly release the corrosion inhibitor.

10. A device for the automatic addition of a corrosion inhibitor into a coolant system to protect a heat exchanger subject to corrosion, comprising a container for the corrosion inhibitor having at least a portion thereof formed of a metal substantially identical to that forming the heat exchanger, said container being so positioned in the coolant system so that said container portion is exposed to the coolant stream.

11. A device as set forth in claim 10, in which said foil packet plus a second charge of corrosion inhibitor is sealed in a larger foil packet, and this packet plus a third charge of inhibitor is sealed in a third foil packet.

12. A device as set forth in claim 10, in which said container portion is formed of a metal foil which will corrode more rapidly than the heat exchanger when in contact with corrosive liquid.

13. A device as set forth in claim 12, in which said container is a foil packet with a predetermined quantity of corrosion inhibitor therein.

14. A device as set forth in claim 13, in which said foil packet is adapted to be placed in a radiator or overflow tank of an automobile coolant system.

15. A device as set forth in claim 14, in which each foil packet is formed of two sheets of foil with all four edges sealed with an adhesive.

16. A device as set forth in claim 15, in which additional strips of metal foil are folded over and adhesively joined to the packet edges.

17. A device as set forth in claim 12, in which said container is a glass or plastic tube having metal foil covering one or both ends and sealed to the tube.

18. A device as set forth in claim 17, in which said tube has a closed end and the metal foil covers the open end.

19. A device as set forth in claim 18, in which the open end of said tube is externally threaded for a screw cap having a central opening therein, said cap acting to seal the foil in the tube.

20. A device as set forth in claim 18, in which said foil is adhesively secured to the exterior surface of the open end of the tube.

21. A device as set forth in claim 20, in which said tube is open at both ends and metal foil covers and is adhesively bonded to the periphery of each open end.

22. A device as set forth in claim 12, in which said container is a metal can having an opening in one end surface, and metal foil covering said opening and adhesively bonded to the end surface around the opening.

23. A device as set forth in claim 22, in which said metal foil is aluminum.

24. A device as set forth in claim 10, in which said container is a metal can having an integral closed end and an opposite open end, and a lid formed of a metal substantially identical to that of the heat exchanger is sealed onto the open end of the can.

25. A device as set forth in claim 24, in which said lid is scored or knurled to provide a limited portion of a lesser thickness than the remainder of the lid metal.

26. A device as set forth in claim 25, in which said lid is formed of aluminum and the scored portion acts to induce crevice or pitting corrosion when in contact with a corrosive liquid.

27. A device as set forth in claim 26, in which said can is positioned in a connection in the inlet or outlet hose of an aluminum radiator so that the aluminum lid is exposed to the coolant passing through the hose.

28. A device as set forth in claim 26, including at least one partition in said container of the same material as and scored or knurled in the same manner as said lid.

29. A device as set forth in claim 28, in which said partitions divide the corrosion inhibitor therein into a plurality of charges to be added sequentially into said coolant system.

30. A device as set forth in claim 26, in which a second smaller container substantially identical to said first container and containing corrosion inhibitor is located within the corrosion inhibitor in said first container.

31. A device as set forth in claim 30, in which a third smaller container substantially identical to said first and second containers and containing corrosion inhibitor is located within the corrosion inhibitor within said second container.

32. A device as set forth in claim 10, in which the corrosion inhibitor is an expandible anhydrous salt so that penetration of the container portion by the coolant results in a rapid expansion of the inhibitor and rupture of the container portion.

33. A device as set forth in claim 10, wherein a spring is positioned in said container and compressed to be biased against said container portion, said container portion having sufficient strength to resist rupture under non-corrosive conditions.

34. A device as set forth in claim 33, in which corrosion of said container portion weakens the portion resulting in rupture thereof by said compressed spring.

35. A device as set forth in claim 33, in which said spring is a coil spring.

36. A device as set forth in claim 33, in which said spring is a leaf spring.

* * * * *